United States Patent [19]

Foust

[11] 4,047,767

[45] Sept. 13, 1977

[54] SLIDE ASSEMBLY

[76] Inventor: Robert K. Foust, 301 Mary Kay Lane, Connersville, Ind. 47331

[21] Appl. No.: 666,961

[22] Filed: Mar. 15, 1976

[51] Int. Cl.[2] ..... F16C 29/02

[52] U.S. Cl. ..... 308/3.6

[58] Field of Search ..... 308/3 R, 3.5, 3.6; 312/334, 348

[56] References Cited

U.S. PATENT DOCUMENTS

| | | | |
|---|---|---|---|
| 2,277,703 | 3/1942 | Kennedy et al. | 308/3.6 |
| 2,865,684 | 12/1958 | Meyer et al. | 308/3.6 |
| 3,589,778 | 6/1971 | Olson | 308/3.6 |

*Primary Examiner*—Joseph F. Peters, Jr.

*Assistant Examiner*—Gene A. Church

*Attorney, Agent, or Firm*—Woodard, Weikart, Emhardt & Naughton

[57] ABSTRACT

A slide assembly is disclosed herein which comprises a free-sliding member received within a pair of rails. The free-sliding member has a generally Z-shaped cross section, and includes a body and flanges extending from opposite edges of the body. The rails are identical and each includes a channel and retainer flange. The flanges of the free-sliding member are received within and bear against the included channel of the respective rails. The retainer flanges engage projections extending from the body of the free-sliding member, thereby restricting relative sliding movement thereof.

10 Claims, 7 Drawing Figures

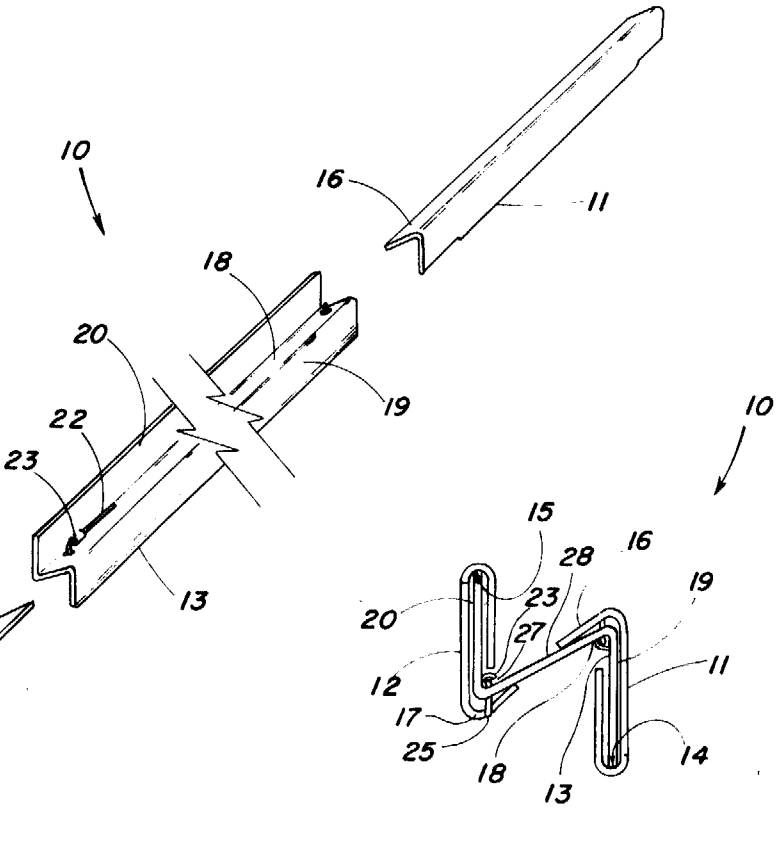
Fig. 1
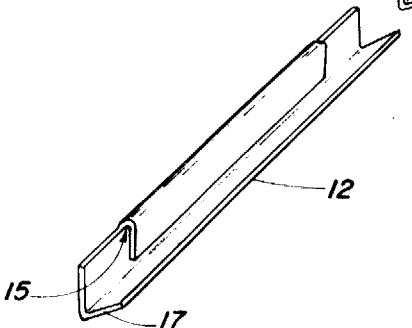
Fig. 2
Fig. 3
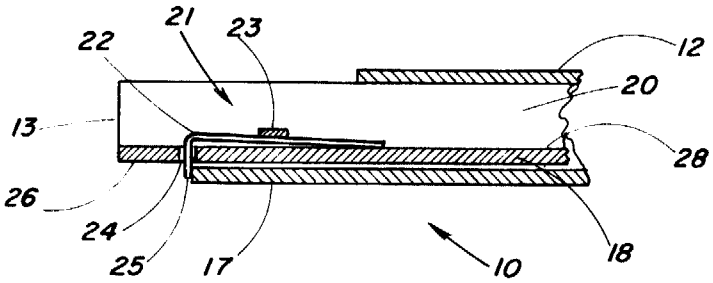
Fig. 4

SLIDE ASSEMBLY

BACKGROUND OF THE INVENTION

1. Field of the Invention

This invention relates to the field of slide assemblies which include a free-sliding member.

2. Description of the Prior Art

Numerous patents have been issued for slide assemblies having a variety of uses. Many of the existing slide assemblies consist of two slide members, one being attached to the supporting structure and the other being attached to the sliding structure. These mechanisms are adequate for many applications.

In some circumstances, however, it is necessary that the slide assembly be capable of supporting a substantial amount of weight when the sliding structure is extended a relatively large distance from the supporting structure. This necessity frequently arises when the supported structure is a drawer. In tool chests, for example, the drawers are typically quite short and shallow, and it is desirable to have the drawer fully extendable from the chest in order to fully utilize the space within the drawer. The tools have substantial weight and the drawer will also be relatively heavy. It is therefore necessary that the drawer slide assembly permit the drawer to fully extend from the chest and yet be capable of supporting the substantial weight represented by the drawer and the contained tools. These properties are also required in other instances.

Telescoping slide mechanisms are disclosed in U.S. Pat. Nos. 3,092,429, issued to Barnes on June 4, 1963, and 2,277,703 issued to Kennedy et al. on Mar. 31, 1942. Each of the disclosed slide mechanisms are capable of supporting a drawer which is fully extended from a cabinet. It is desirable, however, for a drawer slide mechanism capable of performing these functions to constitute less material, and therefore less expense.

SUMMARY OF THE INVENTION

A slide assembly is disclosed herein which comprises a first rail and a second rail, each of the rails including a channel having first and second sides formed by mutually-facing first and second surfaces, each of the rails further comprising a retainer flange extending generally from the first side to the second side, the retainer flange being spaced apart from the second surface and forming an acute angle with a plane parallel to the first surface, an elongated, free-sliding member having a generally Z-shaped cross section, the free-sliding member comprising a flat, elongated body having two longitudinal edges and further comprising a first and a second leg, each leg extending from opposite longitudinal edges of the body, the first leg forming an acute angle with a first surface of the body and the second leg forming an acute angle with a second surface of the body, the first leg being received within and bearing against the channel of the first rail, the retainer flange on the first rail being positioned near the second surface of the body, the second leg being received within and bearing against the channel of the second rail, the retainer flange of the second rail being positioned near the first surface of the body.

It is an object of the present invention to provide a slide assembly which is capable of enabling a drawer to extend its full length.

A further object of the present invention is to provide a slide assembly which is capable of supporting a relatively large amount of weight when supporting a drawer extended to its full length.

Another object of the present invention is to provide a slide assembly which performs the above functions while requiring a minimum amount of material and expense.

Further objects and advantages of the present invention will become apparent from the figures and description which follow.

BRIEF DESCRIPTION OF THE DRAWINGS

FIG. 1 is a perspective view of the slide assembly of the present invention.

FIG. 2 is an exploded view of the slide assembly of FIG. 1.

FIG. 3 is an end view of the slide assembly of FIG. 1.

FIG. 4 is a partial cross-sectional view of a portion of the slide assembly taken along the line 4—4 in FIG. 1.

DESCRIPTION OF THE PREFERRED EMBODIMENTS

Figure 5:
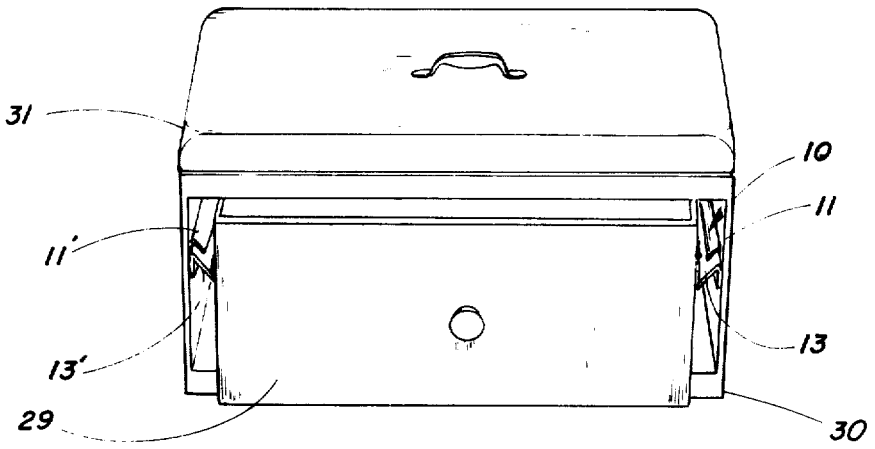
FIG. 5 is a front view of a pair of the slide assemblies of FIG. 1 as they would be employed to support a drawer within a chest.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to FIGS. 1–4, there is shown a slide assembly 10 according to the present invention. The slide assembly 10 comprises first rail 11 and second rail 12, each being received upon a generally Z-shaped free-sliding member 13. The rails 11 and 12 include channels 14 and 15 and retainer flanges 16 and 17, respectively. The free-sliding member 13 comprises a body 18 and legs 19 and 20. Leg 19 is received within and bears against channel 14. Similarly, leg 20 is received within and bears against channel 15.

The free-sliding member 13 includes a pair of identical pin assemblies such as 21 (FIG. 4) on opposite sides and ends of the body 18. Because the pin assemblies are identical except for location, detailed description will be made only for pin assembly 21. The pin assembly 21 comprises a pin member 22 which is generally L-shaped. A clasp 23 is connected to leg 20 and is concave in the direction of the body 18 (FIG. 3). The longer portion of pin member 22 is held within the concave clasp 23, and the shorter portion of the L extends through an aperture 24 (FIG. 4) in body 18. The end 25 of pin member 22 thereby projects from the surface 26 (FIG. 4) of the body 18 to engage the retainer flange 17 of rail 12, preventing disengagement from the free-sliding member 13 at this end.

The end 27 of clasp 23 is spaced apart from surface 28 (FIG. 4) to facilitate assembly of pin assembly 21. The longer portion of pin member 22 is provided with a concave bend relative body portion 18 when pin member 22 is in position. This bend causes the positioned pin member 22 to lie within the concave portion of clasp 23 and to be retained therein. To assemble the pin assembly 21, the shorter portion of the L-shaped pin member 22 is inserted into aperture 24. The longer portion is then rotated against clasp 23. Due to the bend in the longer portion, the pin member 22 will engage the outside, convex surface of clasp 23. Pressure is then applied to the pin member 22 to momentarily reduce the extent of bend in the longer portion. The longer portion is then slipped beneath the end 27 of clasp 23 and against leg 20 of free-sliding member 13. The longer portion will then regain its normal bend and will be trapped by clasp 23. This design makes assembly of the drawer slides simple and inexpensive. The rails, for example, are simply slid onto the free-sliding member prior to installation of the pin members. Also the need for welding or other methods of attachment of the pin members is avoided, as well as the potential related problem of failure of the welding to hold during use. This manner of attachment also permits simple and rapid removal of the pin member 22. This is advantageous since it facilitates replacement of the pin members in the event of damage to them. As noted previously, an identical pin assembly is located on the opposite side and end of body 18 and operates similarly in conjunction with rail 11 and retainer flange 16.

As to the retainer flanges, the primary requirement is that they be properly sized and positioned to engage the respective pin members. The engaging edge of the retainer flange should extend sufficiently along body 18 to assure that the end cannot move away from the body 18 to avoid contact with the pin member. The slide assembly 10, being particularly described, may, of course, be varied substantially while still falling within the purview of the present invention. The precise size and positioning of the various elements can correspondingly be varied. It has been found, however, that the retainer flange should extend less than halfway along body 18, with contact with the pin member being assured by proper sizing of the channel with respect to the received bearing leg of the free-sliding member.

It is apparent that the slide assembly of the present invention has a very simple construction. Each of the rails and the free-sliding member may be formed by forming a flat sheet of metal or other material. The choice of material will depend upon the intended use for the slide assembly. The desirability of the simplicity of the present invention may be more easily seen by reference to other slide assemblies. In U.S. Pat. No. 2,277,703, issued to Kennedy et al. on Mar. 31, 1942, there is shown a slide assembly for use with a drawer. The assembly therein disclosed includes two C-shaped members and a generally H-shaped free-sliding member. The free-sliding member is formed by attaching together two separate U-shaped members, each of which is formed by appropriately bending a flat sheet of material. The slide assembly of the present invention, on the other hand, requires considerably less material than the Kennedy device, and additionally involves a simpler method of assembly.

Figure 6:
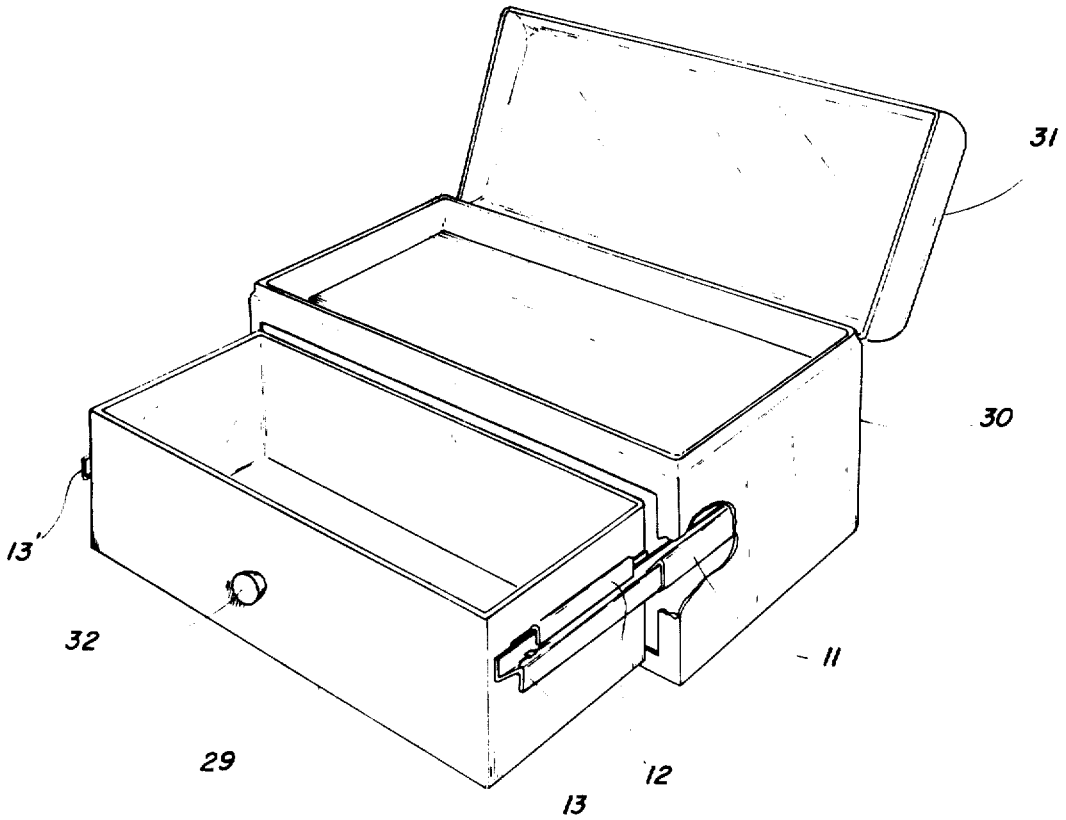
FIG. 6 is a perspective view of the drawer and chest of FIG. 5, the drawer being fully extended from the chest.

Referring now to FIGS. 5 and 6, there is shown a drawer 29 slidably supported within a chest 30 by a pair of identical slide assemblies such as 10. The chest 30 also includes top 31 and drawer pull 32. The first rails 11 and 11' are secured to opposite interior walls of the chest 30. The second rails 12 and 12' are secured to opposite exterior sides of the drawer 29. The free-sliding members 13 and 13' are received within the respective first and second rails, and permit the drawer 29 to be slidably extended from the chest 30.

As stated previously, modifications of the described device can be made while still within the contemplation of the present invention. Such modifications would be obvious to one skilled in the art and could be made as required or desired for the various applications of the disclosed slide assembly. For example, the length of the rails may be varied although it is preferred that the rails be approximately half the length of the free-sliding member. This is desirable since then every point of the free-sliding member is engaged by and supported by one of the rails for any distance of extension of the slide assembly. This is particularly important when substantial weight is being supported by the slide assembly.

The size of the slide assembly components will generally be related to the use for which the slide assembly is intended. In one application, the slide assembly is used to slidingly support the drawers of a tool chest. These drawers typically range from 7 to 17 inches in depth, with a variety of lengths. The length of the rails and free-sliding member naturally has a direct relation to the support strength of the slide assembly. The strength of the assembly is primarily controlled by selection of the material of the free-sliding member. The material from which the rails are formed will generally be the same for a particular application. Thus, for tool boxes the rails preferably comprise a 20 or 22 gauge steel. The free-sliding member may then comprise from 18 to 22 gauge steel. Also, the type of steel utilized in the free-sliding member may be varied to obtain the desired strength for the slide assembly. Further, the strength of the slide assembly depends upon the amount that the flanges of the various components extend. Thus, the slide assembly is made stronger by having the retainer flanges extend further along the body 18 toward the opposite leg and by having the interior channel flanges extend further along the legs toward the body 18 of the free-sliding member 13.

Figure 7:
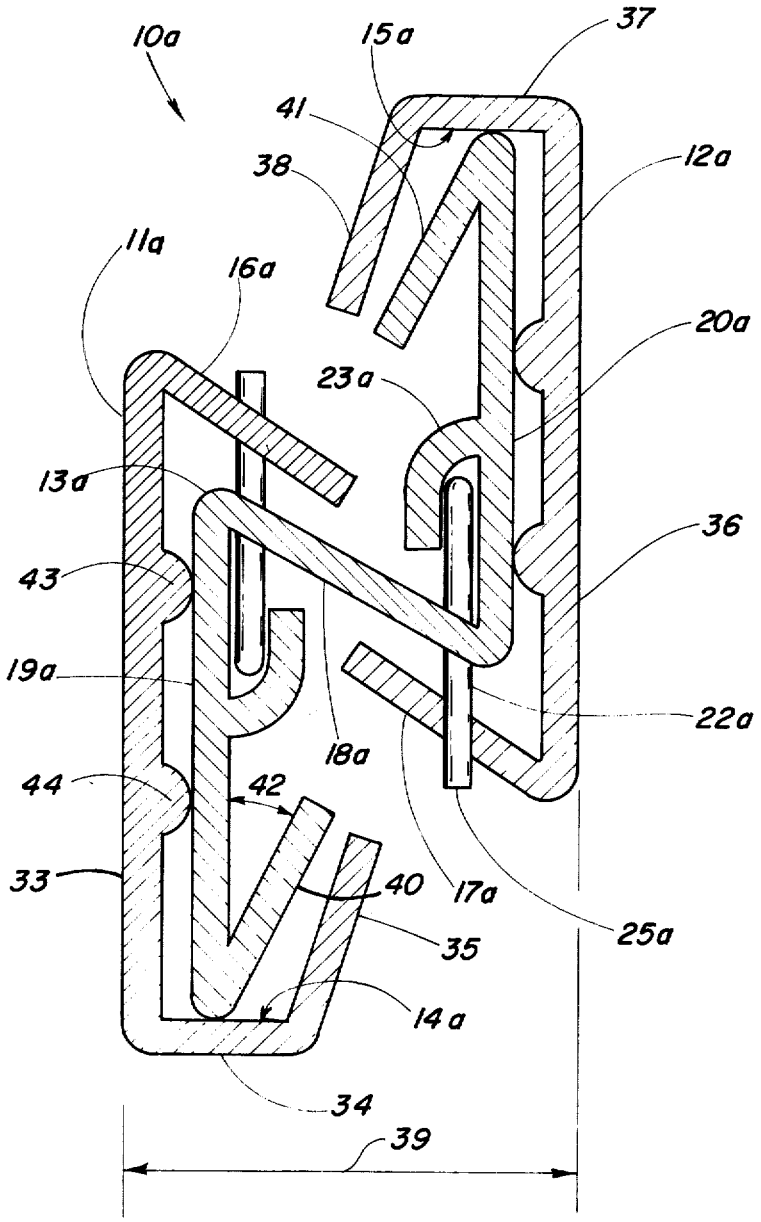
FIG. 7 is an end view of an alternate embodiment of the slide assembly of the present invention.

Another embodiment of the slide assembly **10*a* of the present invention is depicted in FIG. 7 in end view. The rails 11*a* and 12*a* and free-sliding member 13*a*** are similar to the components of the previously-described embodiment. The lengthwise shape is essentially identical except as required by the additional flanges of the components.

Rails **11*a* and 12*a* include channels 14*a* and 15*a* and retainer flanges 16*a* and 17*a*, respectively. The channels 14*a* and 15*a* are formed by flanges 33–35 and 36–38, respectively. The presence of flanges 34 and 37 permit the slide assembly 10*a* to have a greater overall width 39 and also result in increased lateral strength of the slide assembly 10*a* along this width dimension 39**. The provision for a different overall width permits the slide assembly to be more readily adapted to be used, since the space in which the slide assembly would be placed may vary for the various devices.

The free-sliding member **13*a* comprises a body 18*a*, legs 19*a* and 20*a*, and flanges 40 and 41. Leg 19*a* and flange 40 are connected at an angle 42 which may be any acute angle, but is preferably about 30°. The leg 19*a* and flange 40 are received in and bear against channel 14*a*. Flange 35 is set at an angle to flange 33 which is preferably less than angle 42. Any contact between flange 40 and flange 35 will thereby be limited to contact along the end of flange 40 and will therefore result in a minimal amount of sliding resistance. Leg 20*a*** and flange 41 function identically with respect to channel 15*a*.

Detents such as 43 and 44 of rail 11*a* are provided to reduce the surface contact between leg 19*a* and flange 33. This reduces the sliding resistance caused by such contact to a minimum.

In the same manner as previously described, pin assemblies are included in the body 18*a* to provide stops for the rails 11*a* and 12*a*. The pin assemblies are identical except that they are located on opposite sides and ends of the body 18*a*. Pin member 22*a* is held within clasp 23*a* and extends through an aperture in body 18*a*. The end 25*a* thereby projects sufficiently to engage retainer flange 17*a* and to thereby prevent disengagement of the rail 12*a* from the end of free-sliding member 13*a*.

This second embodiment of the slide assembly of the present invention provides excellent support strength. It has been found that this embodiment is preferred for supporting heavier loads for that reason. In use with tool chests, for example, this second embodiment is preferred for use with drawers having a depth of 10 inches or more.

In general, the disclosed drawer slide assembly is a simple and inexpensive device which is capable of supporting a substantial weight. The slide assembly in one application will support a drawer which is fully extended from the associated chest as, for example, in a tool chest. In addition, the slide assembly is superior to previous devices in that it is easier to slide to the extended or non-extended position. In particular, the use of the present slide assembly to support opposite sides of a drawer enables the drawer to be opened with less binding than for most previous devices.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A slide assembly which comprises:

a first rail and a second rail, each of said rails including a channel having first and second sides formed by mutually facing first and second surfaces, each of said rails further comprising a retainer flange extending generally from the first side to the second side, the retainer flange being spaced apart from the second surface and forming an acute angle with a plane parallel to the first surface; and an elongated, free-sliding member having a generally Z-shaped cross section, the free-sliding member comprising a flat, elongated body having two longitudinal edges and further comprising a first and a second leg, each leg extending from opposite longitudinal edges of the body, the first leg forming an acute angle with a first surface of the body and the second leg forming an acute angle with a second surface of the body, the first leg being received within and bearing against the channel of said first rail, the retainer flange on said first rail being positioned near the second surface of the body, the second leg being received within said bearing against the channel of said second rail, the retainer flange on said second rail being positioned near the first surface of the body.

2. The slide assembly of claim 1 in which each of said rails comprises a first vertical flange having a top and bottom horizontal edge and a second vertical flange, the second vertical flange being attached to one of the horizontal edges of the first vertical flange, the retainer flange being attached to the other of the horizontal edges of the first vertical flange and forming an acute angle therewith.

3. The combination of:

a support structure;

a sliding structure operable to move relative to said support structure; and the slide assembly of claim 1, one of said rails being attached to said support structure and the other of said rails being attached to said sliding structure.

4. The combination of claim 3 which further comprises a second slide assembly, said second slide assembly comprising a third rail and a fourth rail, each of said third and fourth rails including a channel having first and second sides formed by mutually facing first and second surfaces, each of said third and fourth rails further comprising a retainer flange extending generally from the first side to the second side, the retainer flange being spaced apart from the second surface and forming an acute angle with a plane parallel to the first surface, said second slide assembly further comprising a second, elongated, free-sliding member comprising a flat, elongated body having two longitudinal edges and further comprising a first and a second leg, each leg of the second free-sliding member extending from opposite longitudinal edges of the body of the second free-sliding member, the first leg forming an acute angle with a first surface of the body of the second free-sliding member and the second leg forming an acute angle with a second surface of the body of the second free-sliding member, the first leg being received within and bearing against the channel of said third rail, the retainer flange on said third rail being positioned near the second surface of the body of the second free-sliding member, the second leg being received within and bearing against the channel of said fourth rail, the retainer flange on said fourth rail being positioned near the first surface of the body of the second free-sliding member, one of said rails of said second slide assembly being attached to said support structure and the other of said rails of said second slide assembly being attached to said sliding structure.

5. The combination of claim 4 in which each of said rails comprises a first vertical flange having a top and bottom horizontal edge and a second vertical flange, the second vertical flange being attached to one of the horizontal edges of the first vertical flange, the retainer flange being attached to the other of the horizontal edges of the first vertical flange and forming an acute angle therewith.

6. The combination of claim 5 in which each of said rails comprise a single piece of sheet metal, the sheet metal being bent to form the three flanges.

7. The combination of claim 6 in which said rails are identical.

8. The combination of claim 7 in which all of the acute angles are approximately equal.

9. The combination of claim 8 in which said rails further comprise stop means for preventing at least one of said free-sliding members from sliding relative said rails beyond a preselected point.

10. The combination of claim 8 in which said stop means includes a first projection extending from one surface of the body of said free-sliding member near one end and a second projection extending from the other surface of the body of said free-sliding member near the other end, each projection being engaged by the retainer flange positioned near the surface of the body from which the projection extends when the rail which includes the retainer flange is slid relative the free-sliding member in the direction of the projection.

* * * * *